US006568340B2

(12) United States Patent
Dec et al.

(10) Patent No.: US 6,568,340 B2
(45) Date of Patent: May 27, 2003

(54) MOTORIZED WAKEBOARD

(76) Inventors: Andrzej Dec, 948 Rambling Dr., Rochester Hills, MI (US) 48307; Piotr Dec, 700 Michigan Avenue, Windsor, Ontario (CA), N9J 2E6

( * ) Notice: Subject to any disclaimer, the term of this patent is extended or adjusted under 35 U.S.C. 154(b) by 0 days.

(21) Appl. No.: 09/992,595

(22) Filed: Nov. 14, 2001

(65) Prior Publication Data

US 2002/0056408 A1 May 16, 2002

Related U.S. Application Data

(60) Provisional application No. 60/248,066, filed on Nov. 14, 2000.

(51) Int. Cl.[7] ..... B63C 7/00
(52) U.S. Cl. ..... 114/55.56; 441/74
(58) Field of Search ..... 441/74; 114/55.56

(56) References Cited

U.S. PATENT DOCUMENTS

| | | | | |
|---|---|---|---|---|
| 2,434,700 | A | 1/1948 | Keckley | |
| 3,262,413 | A | 7/1966 | Douglas et al. | |
| 3,292,373 | A | 12/1966 | Tado | |
| 3,324,822 | A | 6/1967 | Carter, III | |
| 3,369,518 | A | 2/1968 | Jacobson | |
| 3,426,724 | A | 2/1969 | Jacobson | |
| 3,463,116 | A | 8/1969 | Dawson | |
| 3,481,303 | A | 12/1969 | Tate et al. | |
| 3,548,778 | A | * 12/1970 | Smagala-Romanoff | 441/74 |
| 3,608,512 | A | 9/1971 | Thompson | |
| 3,882,815 | A | 5/1975 | Bennett | |
| 4,020,782 | A | 5/1977 | Gleason | |
| 4,237,812 | A | 12/1980 | Richardson | |
| 4,274,357 | A | 6/1981 | Dawson | |
| 4,321,048 | A | 3/1982 | Marchese et al. | |
| 4,457,724 | A | 7/1984 | Miyamoto | |
| D276,994 | S | 1/1985 | Montgomery et al. | |
| 4,538,996 | A | 9/1985 | Inwood | |
| 5,017,166 | A | 5/1991 | Chang | |
| 5,096,446 | A | 3/1992 | Tazaki et al. | |
| D330,928 | S | 11/1992 | Sameshima | |
| 5,254,024 | A | 10/1993 | Kobayashi et al. | |
| D355,400 | S | 2/1995 | Montgomery | |
| 5,582,529 | A | 12/1996 | Montgomery | |
| 5,628,269 | A | 5/1997 | Henmi et al. | |

FOREIGN PATENT DOCUMENTS

| | | | |
|---|---|---|---|
| FR | 2617-793 | 1/1989 | 114/55.5 |
| JP | 1-148694 | 6/1989 | 114/55.5 |
| JP | 1-144284 | 6/1990 | 114/55.5 |
| JP | 3-295791 | 12/1991 | 114/55.5 |

* cited by examiner

*Primary Examiner*—Ed Swinehart
(74) *Attorney, Agent, or Firm*—Clark Hill PLC

(57) ABSTRACT

A wakeboard assembly transports a rider across a body of water. The rider defines a rider center of gravity. The wakeboard assembly includes a hull that extends between a stem and a stern. The hull defines an interior compartment and a deck for receiving the rider thereon during operation of said wakeboard assembly. An engine is mounted to the hull within the interior compartment. The engine is mounted to the hull at a position between the stem and the stern below the deck. The engine is mounted such that the engine extends through the center of gravity of the rider.

4 Claims, 4 Drawing Sheets

MOTORIZED WAKEBOARD

This application claims benefit of provisional Ser. No. 60/248,066 filed Nov. 14, 2000.

BACKGROUND ART

1. Field of the Invention

This invention relates to a wakeboard, more specifically, the invention relates to a motorized wakeboard.

2. Description of the Related Art

The invention is a non-traditional personal watercraft defying standard categorization.

Until now, those who enjoy riding certain watercrafts, commonly known as boards, in particular the boards that have the ability to jump, were able to: windsurf (also known as sailboarding) and wakeboard. Windsurfing is a form of surfing propelled by wind that applies a force to a sail. Windsurfer uses waves as ramps to jump above water surface and then uses the sail like a wing to control and to extend the jump.

Wakeboarding is a water sport in which a rider negotiates waves and wakes (waves created by boat) behind a powerful towing boat and executes controlled jumps that are the main attraction of the sport of wakeboarding. The wakeboard rider controls and executes jumps by skillfully using and coordinating both the hydrodynamic forces present on the bottom and side surfaces of a wakeboard and fins as well as by holding on to a towing rope that is attached to the towing boat.

A new type of board is gaining popularity: a kiteboard. Kiteboarding is similar in concept to windsurfing (sailboarding) but it utilizes a kite to pull rider along surface of water and into the air during jumps. Again, the main attraction of this sport is the ability to perform long and controlled jumps above water.

The windsurf board, kiteboard and other boards that use the forces of nature to propel them, have the disadvantage of being dependant on the right weather conditions. In most locations in the world, there are a very limited number of days a year that users are able to enjoy those sports. The wakeboard is not dependent on weather conditions, but its disadvantage is the requirement for a boat to pull the wakeboarder and at least one additional person to operate such boat.

Applicants have created several types of motorized boards for riding on water (further referred to as motorized boards) to free their users from the dependency on weather or other people and equipment. All those motorized boards, however, were created to simulate surfboards and allow users to enjoy the sport of surfing in the absence of waves. Surfing does not include and is not capable of jumping above water surface and, therefore, these motorized surfboards did not address the issues related to jumping. Many of these motorized boards are not capable of achieving the high speeds necessary to initiate jumps above water surface. The others that are capable of operating at high speed have a high moment of rotational inertia preventing riders from controlling their craft during the course of jumping. The controlled maneuvers of a board during jumping are the main attraction of jumping. Furthermore, this lack of the ability to control a craft after the craft becomes airborne is extremely hazardous for the rider. The most difficult and most dangerous part of jumping is landing. Consequently, to land safely, the rider cannot be at a mercy of the very initial phase of the jump, which is the time when the craft leaves water, but rider must be in control during all of the phases of the jump. All of the motorized boards lack the ability to control them after they become airborne. Any action causes a reaction. When a rider spins an airborne motorized board in one direction, the rider's body spins in the opposite direction. The larger the rotational moment of inertia of a motorized board the more a rider spins in the opposite direction than the direction of spinning of his board. The placement of the engine in the motorized boards, especially placement engine at a distance from the vertical axis that passes through rider's center of gravity, is the major contributor to the high moment of inertia of the devices. As explained subsequently, the high moment of rotational inertia of the motorized boards, requires the rider to rotate his body over 120 degrees to rotate the airborne motorized boards just a few degrees. This means that the rider faces the back of the board trying to perform this airborne maneuver. For most humans this is neither practical nor possible.

Also, the moving of a stem up and down is a form of rotation about a horizontal axis that passes through a board, perpendicular to the board longitudinal axis, half way between rider's feet. Because moving a stem up and down is a form of rotation about this axis, therefore the high rotational moment of inertia of the prior art boards has a detrimental effect on the amount of effort a rider has to exert in order to move a stem up and down (also known as rocking) or to control the angle of attack of the board, both during airborne ascending and descending. The effect of the rotational moment of inertia on ability to control a motorized board is subsequently explained in greater details in Description of Prior Art and in the Summary of Invention.

All motorized boards have engine positioned either in the front part of a motorized board (Bennet), central part of a motorized board (J. Douglas, A. Bloomingdale, R. Montgomery, J. Thomson, Von Smagala-Romanov) or in the very rear part of a board (R. Montgomery, E. Dawson, A. Sameshima, D. Bennet, H. Yoshitake). None of those positions coincide with the vertical axis that passes through rider's center of gravity, which is the axis that rider rotates his craft around while airborne. The rider's position depends on the board length. For the length of the standard board, which is between 2.44 and 3.35 m (8 to 11 feet), the rider position is approximately 0.3 to 0.4 of the board length measured from the rear of the board. The references discussed above show the engine in a position that does not offer good riding characteristics on water and offer even worse characteristics during jumping. While some of these references allow for moderately controllable surfing (U.S. Pat. No. 5,582,529 to R. E. Montgomery), none of it will allow executing very difficult and fully controlled jumps above water surface.

U.S. Pat. No. 3,548,778 to Von Smagala-Romanov discloses a self-propelled surfboard. The shielded propeller is located in a recess in the bottom of the board. The internal combustion engine is mounted within a cavity located centrally of the front and rear ends of the board in front of rider. The propeller is mounted closely behind the engine so as to be generally under the deck portion where a rider would stand. This limits the craft to be operated at low speeds only, commonly known as displacement operation. The reason for this is that at a high speed, also known as planing, only the very rear portion of the bottom is in contact with water, at which time the craft of Von Smagala-Romanov would ingest air instead of water into the jet pump, and would lose the propelling thrust. Von-Smagala-Romanov teaches in lines 23–24 of column 6, that shield around propeller ingests water through apertures in the shroud. This is a very hydrodynamically inefficient way of ingesting water, which further limits the output of his propulsion system.

The Von-Smagala-Romanov reference also teaches in lines 32–35 of column 6, that the craft has a fin located in the path of the water jet stream. This feature has two disadvantages: (a) it creates a very large resistance to the stream of water that floats around it at a very high speed, thus further reduces the propelling thrust, and (b) it loses the ability to work as a stabilizer and steering feature should rider decide to steer the board with body balance. The reason for this is that in order to steer with body balance, the fin must interact with the outside (stationary) water, not with the stream of water generated by the propeller. This stream always meets the fin at the same angle, regardless of riding conditions. In practice this stream of water always meets the fin parallel to the side surfaces of the fin, and effectively shields the fin from interacting with the outside water. Without a movable part of the fin of the Von-Smagala-Romanov craft, the fin cannot be used to aid in steering, especially in steering with body balance. The Von-Smagala-Romanov reference discloses a low speed craft that cannot be made to turn without the use of a rudder, movable jet or other mechanical steering apparatus. Effective steering by body balance is only possible at planing speeds. The Von-Smagala-Romanov reference discloses that the device could be made steerable by incorporating an optional mechanized fin using appropriate cables controlled by rider.

Furthermore, careful study of Von-Smagala-Romanov device indicates that it is a low speed craft incapable of becoming airborne by rocking it or by using a wave or wake as a ramp for jump. Rocking a board is a term used to describe moving the board stem up and down by rider. To become airborne a high planing speed in excess of 32 kilometers per hour (20 mph) is required.

By indicating that the craft can be made steerable by using a rudder, movable jet, mechanized fin or other mechanical steering apparatus, the Von-Smagala-Romanov disclosure shows that he did not consider the location of the engine as being a factor in turning, especially in airborne turning. The Von-Smagala-Romanov reference teaches in lines 14–16 of column 6, that engine is mounted in a cavity that is located intermediate of the craft's front and rear ends. This central engine location causes the craft rotational moment of inertia around vertical axis that passes through rider center of gravity to be excessively high, thus effectively rendering the craft uncontrollable during the time the craft is airborne. The effect of engine central position on the rotational moment of inertia of a craft is subsequently explained in detail.

U.S. Pat. No. 5,582,529 to Robert E. Montgomery discloses a motorized water ski. The motorized water ski is steerable by rider changing the position of his body in relation to other parts of the board. The water ski has a motor disposed within the hull. In lines 18–19 of column 21, Montgomery teaches that the water ski has the motor mounted forward of the deck, and hence forward of the rider standing on deck. This is similar to the invention disclosed in the Von-Smagala-Romanov reference. By indicating that the intention of his invention is to have the motor mounted forward of the deck, which supports a standing rider, the Montgomery reference shows the rotational moment of inertia of the craft was not considered and the influence of engine location on minimizing this rotational moment of inertia as a factor in turning the craft, especially in airborne turning, was not appreciated.

The following example illustrates how critical engine position is in terms of the amount of moment (also known as torque) that a rider needs to exert to rotate a motorized board when airborne. The moment of rotational inertia of a compact size 17.7 kg (39 lb.) engine alone, around vertical axis that passes through the center of gravity of rider (the case in airborne turning), is approximately 10.3 kg*sq-m (243.5 lb*sq-ft) for the Montgomery craft. This high moment of rotational inertia renders this craft unsuitable for airborne maneuvering. The moment of inertia of engine around the same axis, when the same engine is moved from position in front of deck to below deck directly under center of gravity of rider, is only 0.16 kg*sq-m (3.8 lb*sq-ft), which is 63 times lower than that of the rotational moment of inertia of engine in the Montgomery craft. The moment required to rotate an object in a given time is directly proportional to the moment of inertia of the object. Therefore, one can appreciate that the moment a rider has to produce to rotate just engine (in a given time) is 63 times lower when engine is moved from the location in front of deck (in the Montgomery craft) to location directly below center of gravity of rider. Even a very small distance between the center of gravity of the heaviest component of a motorized water ski, engine, and the vertical axis that passes through the rider center of gravity will cause a large increase in the moment required to rotate the craft, versus when the center of gravity of engine coincides with the vertical axis that passes through the rider center of gravity. The Montgomery board, by its shear power of engine, will allow rider to jump above water surface, but because of the requirement for such a high moment to rotate his board, after it loses contact with water the rider also loses most of the control over the craft.

Yet another disadvantage of the Montgomery craft is that the minimum length of the craft is limited to approximately 2.28 m (7.5 feet). For a motorized board suitable for jumping, a short length is desirable, preferably between 1.8 and 2.4 m (6 and 8 feet). If the Montgomery craft is shorter than 2.28 m (7.5 feet), the engine has to be positioned very close to the front of the craft so as to leave enough space on the deck for a rider. The vertical thickness of the frontal portion of the board is always substantially less than the central and rear portions. Additionally, the bottom of the frontal portion raises up as it approaches the bow. Positioning of engine in the frontal portion will raise the engine in the Montgomery craft and cause the engine to protrude high above the deck level, thus increase the overall height of the board. This creates package and transportation problems, and makes the look of the board very unappealing.

U.S. Pat. No. 3,262,413 to J. S. Douglas discloses a motorized surfboard. As Douglas teaches in lines 11–15 of column 1, this motorized surfboard maintains appearance and functional characteristics of the classical surfboard and is designed to propel a surfer out to the breakers so as to allow him traditional surfing upon arrival at the breakers. Accordingly, the Douglas motorized surfboard is a very low power surfboard that neither requires nor is it capable of achieving planing speeds needed for jumping above water. Like in the Von-Smagala-Romanov craft, the point of water ingestion into the jet pump is positioned centrally. Therefore, it would be above water level at planing speed. In lines 11–13 of column 3, the reference teaches that speed of the water jet reaches only several knots, thus the maximum speed of his motorized surfboard is also only several knots. The minimum speed required for effective jumping is 32 kilometers per hour (20 mph). It is not possible to make the Douglas craft achieve planing speeds because the motorized surfboard of Douglas cannot incorporate a water pump with inlet positioned close to the rear of the board. This is because the exit of the engine exhaust in Douglas craft is below bottom and forward of the rear portion of craft. As Douglas teaches in lines 3–5 of column 11, exhaust tube is ported through the aft surface of the body hull. Any water pump inlet positioned near the exhaust exit would ingest exhaust fumes resulting in total loss or large reduction of propelling force. Therefore, the only possible place for water pump intake is in the central or front portion of the Douglas craft, which as explained before is not suitable for planing speeds.

As Douglas teaches in lines 10–15 of column 4, the engine is positioned in the midportion of the hull body, between forward and aft compartments. As taught by Douglas in line 15 of column 1, the length of his craft is of classical surfboard length, which is (not mentioned by Douglas) 2.74 to 3.35 m (9 to 11 feet). Therefore, for this craft length, like in the Von-Smagala-Romanov and in the Montgomery crafts, this positions engine is substantially in front of a rider standing on deck, resulting in a very high moment of rotational inertia of the craft around vertical axis that passes through the center of gravity of rider. Douglas shows that he did not consider the location of the engine as being a factor in turning, especially in airborne turning. Furthermore, careful study of Douglas device indicates that it is a low speed craft incapable of becoming airborne neither by rocking it by rider nor by using a wave or wake as a ramp for jump.

In a French Pat. No. 2,617,793, J. F. Trotet depicts an engine, which is mounted below the forward foot of the rider for one of the two positions that his craft can be ridden. Both feet of the rider are substantially behind the engine in the second riding position. Apart from the fact that the center of gravity of engine is still in front of the center of gravity of rider, the Trotet invention pertains to a different watercraft, with very different riding characteristics that is steered by a rudder and handle which makes it a different category watercraft. The Trotet design is a displacement type craft, which can never achieve high planing speeds necessary for jumping above water, without a very large and extremely powerful engine (over 50 hp), not feasible for packaging in this type of a craft. The large submerged area, also known as a wetted surface, requires the craft to be steered by active means like a rudder shown in the patent. For those reasons our invention is different and does not apply to the type of craft described by Trotet.

Any effect of placement of engine on the craft rotational moment of inertia around the vertical axes that passes through rider center of gravity is an incidental element in the prior art and not essential to the ease of airborne maneuverability of the prior art devices.

SUMMARY OF THE INVENTION

A wakeboard assembly transports a rider across a body of water. The rider defines a rider center of gravity. The wakeboard assembly includes a hull that extends between a stem and a stern. The hull defines an interior compartment and a deck for receiving the rider thereon during operation of said wakeboard assembly. An engine is mounted to the hull within the interior compartment. The engine is mounted to the hull at a position between the stem and the stern below the deck. The engine is mounted such that the engine extends through the center of gravity of the rider.

It is a fundamental object of this invention to provide a self propelled, steered by body balance, board type watercraft that enables a rider to perform jumps above water surface, both on flat water and on waves, similar to those attributed to wakeboarding, sailboarding, and kiteboarding without the need for a towing boat, sail or a kite.

Yet another object of this invention is to provide a motorized wakeboard with low rotational moment of inertia around the vertical axis that passes through rider center of gravity so as to enable rider to control an airborne craft with a small effort, feasible for an average size and strength person.

Yet another object of this invention is to provide a craft which retains its riding characteristics and still provides a large flat deck area to support a rider, regardless of the craft length, especially a short length.

Yet another object of this invention is to provide a self propelled board type watercraft with a generally flat deck throughout its length, therefore a craft that is visually appealing.

Our years of experimenting each that in order to be able to control any motorized board while airborne, the rotational moments of inertia of a motorized board around (a) the vertical axis that passes through rider center of gravity, and (b) around the horizontal axis that passes through the board and is equally distant from the rider feet, must be very small. The low rotational moment of inertia of a craft around the vertical axis that passes through rider center of gravity, enables rider to easily rotate an airborne motorized wakeboard, by his feet, clockwise and counterclockwise around the vertical axis that passes through rider center of gravity, or to easily stop such rotation. One can easily appreciate how minimizing of rotational moment of inertia benefits the rider, when one looks at a person spinning on a rotating chair with simultaneous extending and then bringing both hands close to their chest. With hands close to the chest the moment of inertia is smaller, thus allowing the person to spin faster. Any action causes a reaction. When the rider spins a motorized wakeboard in one direction, the rider's body will spin in the opposite direction. The smaller the rotational moment of inertia of the motorized wakeboard the smaller angle a rider will spin in the opposite direction than the board spinning direction and the less effort a rider has to exert to spin the motorized wakeboard. By coinciding the center of gravity of engine with a vertical axes that passes through the center of gravity of the rider, the motorized wakeboard of the present invention, achieved low moment of rotational inertia, therefore achieved extreme ease of maneuverability during the times when rider jumps with the board above the surface of water.

Low rotational moment of inertia also allows rider to easily move the stem (also known as nose or bow) of the motorized wakeboard up and down (also known as rocking) or to keep steady any desired angle of attack of the motorized wakeboard, both during airborne ascending and descending. The moving of stem up and down is a form of rotation about a horizontal axis that passes through a board perpendicular to the board longitudinal axis equally distant from rider's feet. Because moving a stem up and down is a form of rotation, therefore the low rotational moment of inertia around this axis has a detrimental effect on the amount of effort a rider has to exert in order to move a stem up and down while airborne. By coinciding the center of gravity of the heaviest component of a motorized wakeboard, an engine, with the above horizontal axis, the rotational moment of inertia of a motorized wakeboard around this axis is minimized. This engine placement makes rocking of an airborne motorized wakeboard possible even if it is equipped with a heavy, over 13.6 kg (30 lb.) engine.

Because during airborne operation, rider controls a craft with his feet, the placement of engine in our motorized wakeboard is relative to the rider position as rider operates a craft, and is positioned directly below rider. The position of rider, as rider operates a craft is also referred to as the preferred rider position. Most types of boards include foot straps, that are mounted in such locations that they retain rider feet precisely in this preferred rider position. The preferred rider position is dependent on the length of a motorized wakeboard. For long motorized wakeboards, 2.74 to 3.35 m (9 to 11 feet) in length, the most preferred rider position is located approximately 30 to 40% of the board length, measured from the board rear towards the board center. The shorter the motorized wakeboard the closer to the board center the preferred rider position is. For a motorized wakeboard of 1.52 m (5 feet) in length, the preferred rider position is directly above the board center. None of the prior art locates engine center of gravity directly below rider's center of gravity, as rider operates a motorized board, so as to minimize the motorized board rotational moment of inertia around (a) horizontal axis that passes through motorized board the same distance from either of rider's foot, and (b) around vertical axis that passes through the center of gravity of rider, so as to enable rider control of a board while airborne.

At the same time, this placement of engine greatly improved riding characteristics of the motorized wakeboard when operated on water, allowing for tighter turns (less than 3 meters radius).

The effect of placement of engine on the craft rotational moment of inertia around the vertical axes that passes through rider center of gravity is an incidental element in the prior art and not essential to the ease of airborne maneuverability of the prior art devices. As new sporting goods entered the market and people experienced the excitement of their unique abilities, they became experts in using them and expect to find the same ability in the next generation products. For those who experienced snowboarding, surfing and wakeboarding, a motorized board that offers only the experience of surfing is no longer challenging or very appealing.

Therefore, it is an object of this invention to provide a self propelled board type watercraft that can operate with agility on a surface of water, while enabling rider to perform controlled airborne maneuvers, with the ability to propel itself above water surface.

Still further objects and advantages will become apparent from a consideration of the ensuing description and accompanying drawings.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENTS

Figure 1:
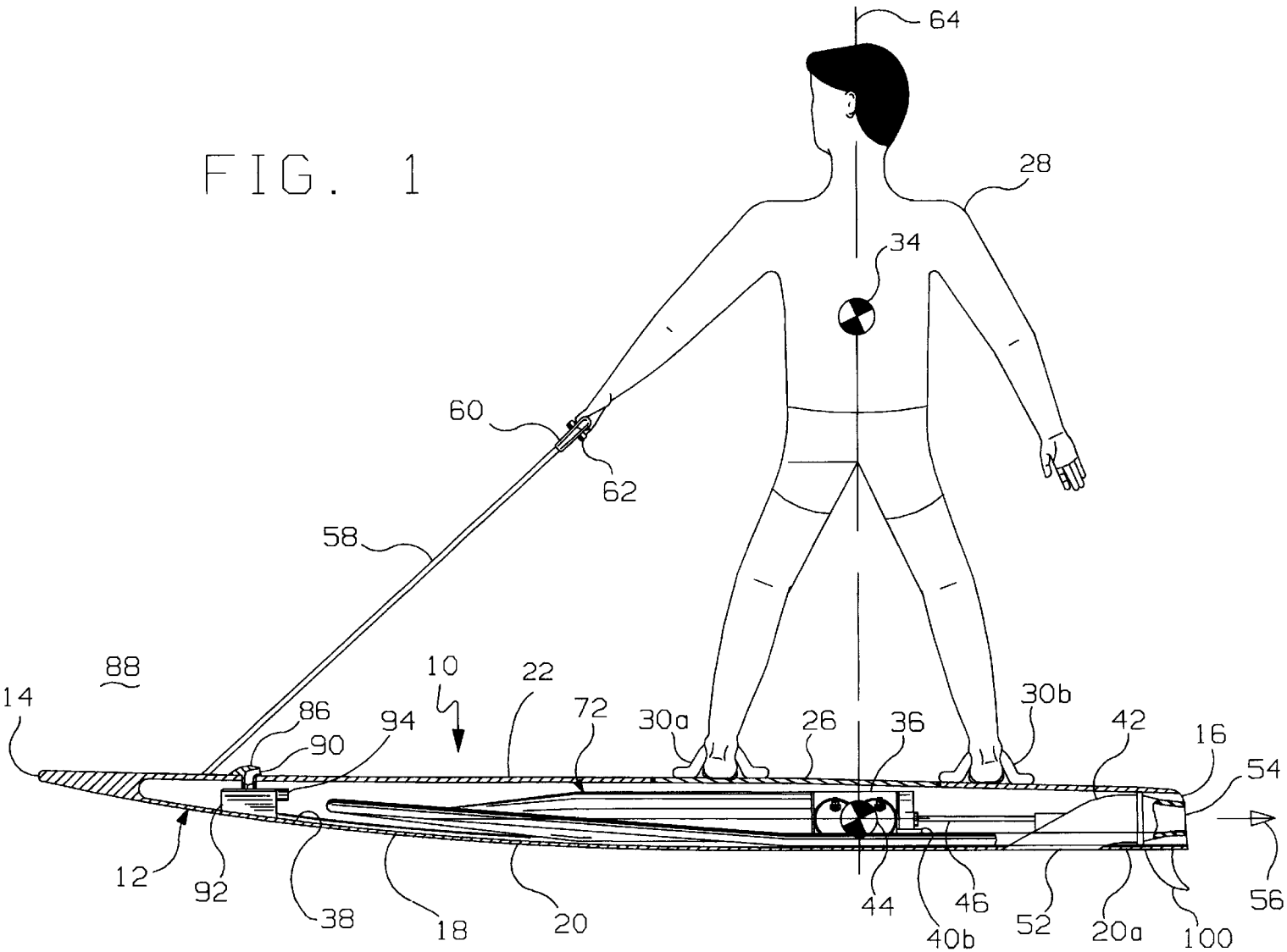
FIG. 1 is a cross-sectional side view showing the embodiment of the motorized wakeboard assembly according to the present invention with a rider in a riding position as the motorized wakeboard is operated.

Now, embodiments of the invention will be described with reference to drawings.

Referring to Figures, there is disclosed a motorized wakeboard 10 includes a hull 12. The hull 12 is preferably made from an epoxy resin and fiberglass composite material. The hull 12 defines a stem 14, a stern 16, a bottom shell 18 and a deck 22. The bottom shell 18 also includes a bottom exterior surface 20, with a generally horizontal rear portion 20*a*. The hull 12 defines an interior compartment 24, which is substantially enclosed by the hull 12. The deck 22 includes an access door 26 so as to provide access to the interior compartment 24. When the access door is attached to the deck 22, the access door becomes a part of the deck 22. The deck 22, including the access door 26, is generally flat and provides support for a rider 28. The deck 22 is defined in front by the stem 14 and at the rear of the stern 16. More specifically, the deck 22 defines a riding surface 23 having a center thereof.

For the most part of riding on the motorized wakeboard, the rider 28 assumes preferably a sideways stance position on the deck 22 as shown in FIG. 1. The rider 28 preferably keeps his feet inside a foot strap 30*a* and a foot strap 30*b* so as to improve his body balance and improve the transfer of forces from his feet onto the motorized wakeboard 10. The foot straps 30*a*, 30*b* are attached to the deck 22 and to the access door 26 equidistantly from the center of the riding surface 23 of the deck 22. More foot straps can be mounted or rider can remove all of them, so as to accommodate his needs. It may be appreciated by those skilled in the art, that in an alternative embodiment (not shown), all the foot straps can be attached to the deck 22. Yet in another alternative embodiment (not shown), all the foot straps can be attached to the access door. Numeral 32 designates a fire extinguisher compartment. A center of gravity of the rider 28 is designated generally as 34.

An engine 36, preferably an internal combustion engine, is mounted inside the interior compartment 24 to an interior surface 38 of the bottom shell 18. More specifically, the engine 36 is mounted to an engine mount 40*a*, an engine mount 40*b*, and an engine mount 40*c*, which extend out from the bottom interior surface 38. An axial flow water pump 42 is mounted to the bottom near the stern 16, so as to provide propelling thrust to the motorized wakeboard. Numeral 44, designates a center of gravity of the engine 36. The engine 36 is mounted to the interior surface 38 at a location that allow the rider 28 the ability to substantially align the engine center of gravity 44 with the center of gravity 34 of the rider 28. In the preferred embodiment, the centers of gravity 34, 44 are coaxial. The centers of gravity 34, 44 may, however, be as far as six inches from each other. In other words, the engine 36 may be in front of the rider 28 such that the engine center of gravity 44 may be as much as six inches in front of the center of gravity 34 of the rider 28.

A shaft 46 is connecting the engine 36 with a propeller 47. In the preferred embodiment, the propeller 47 is housed inside the water pump 42. The shaft 46 is connected with the engine 36 via a coupling 48. The water pump 42 draws a portion of an outside water 50 through an inlet port 52 in the bottom shell 18 and discharges the water 50 through an outlet port 54 in the stern 16 in a direction 56 so as to create the propelling thrust to the motorized wakeboard 10. It may be appreciated by those skilled in the art that, in an alternative embodiment (not shown), the shaft 46 may extend below the bottom and a traditional boat propeller, preferably shrouded, will propel the motorized wakeboard.

Figure 2:
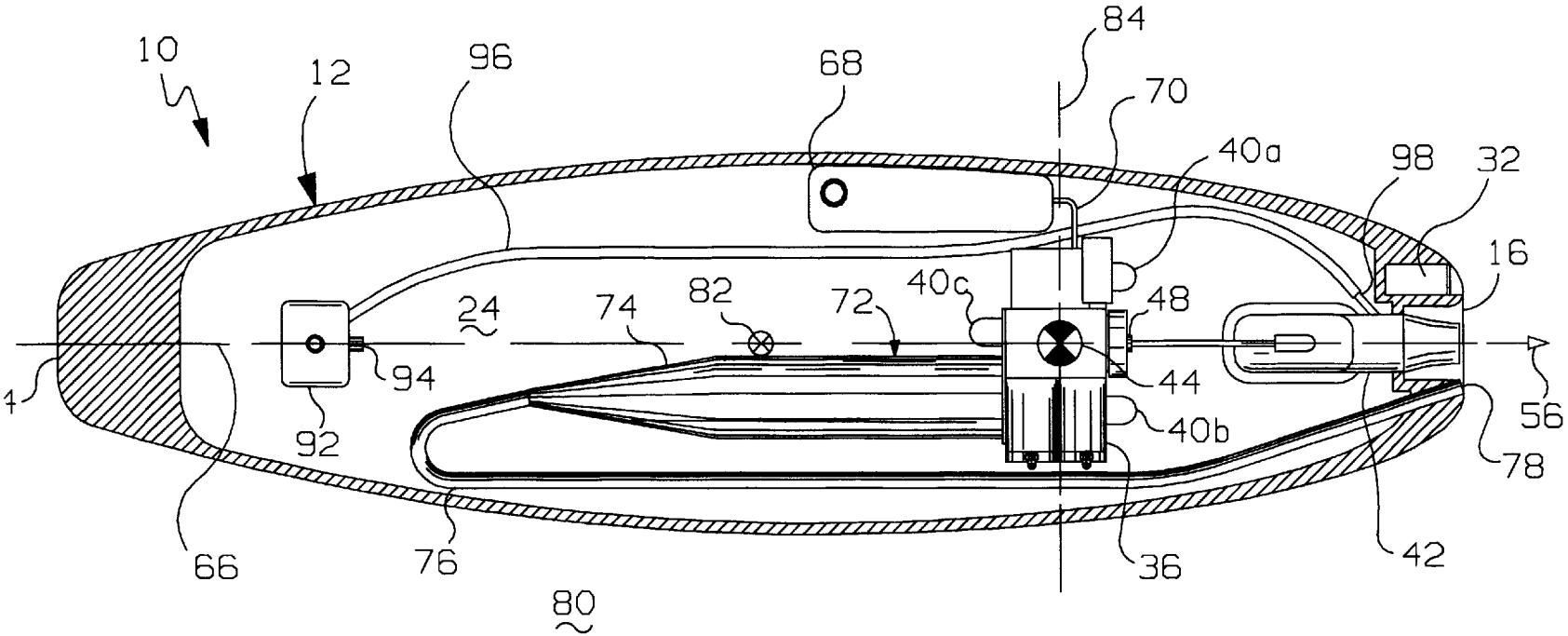
FIG. 2 is a sectional top view of the invention showing the embodiment of the motorized wakeboard assembly with the top of the craft removed therefrom.
Figure 3:
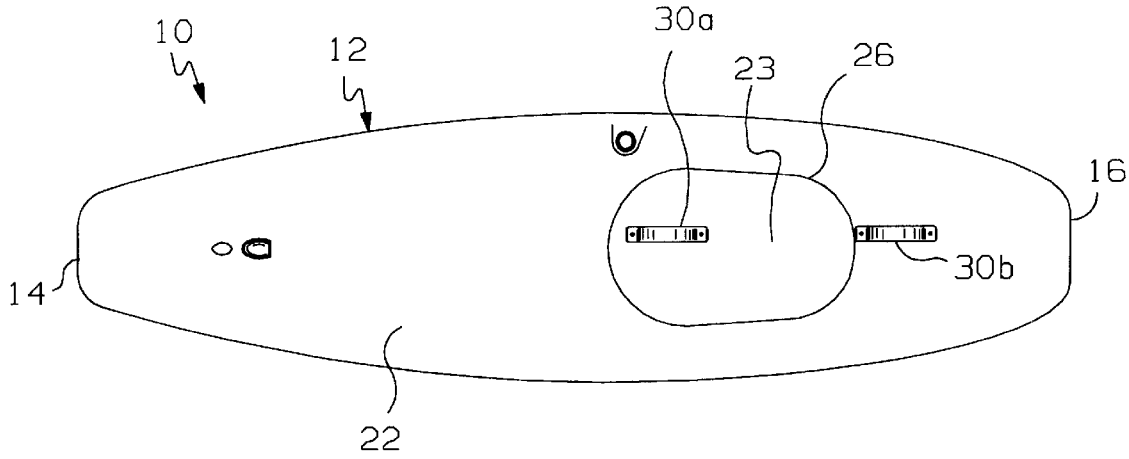
FIG. 3 is a top view of the invention showing the embodiment of the motorized wakeboard assembly with the throttle cable, and handle removed therefrom.
Figure 4:
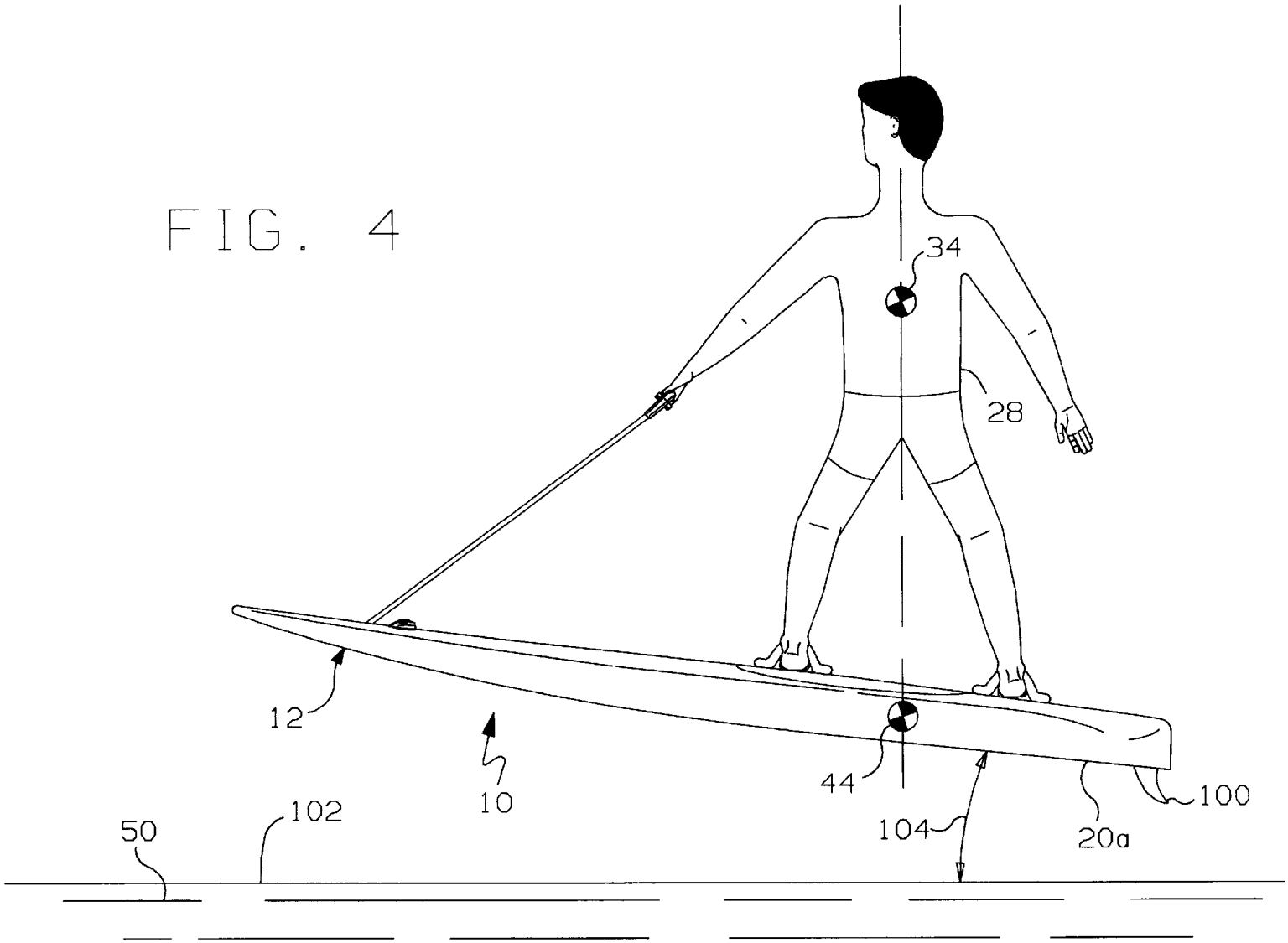
FIG. 4 is a side view of the invention with a rider in a riding position as the motorized wakeboard is operated during a jump above water.

The rider 28 controls output force of the engine 36 via a throttle cable 58. The throttle cable 58 includes a handle 60 which has a throttle control device 62 and a safety switch (not shown) which is required by law, that stops the engine should the rider fall off the motorized wakeboard. The handle 60 has also a choke, a start and a stop switch (not shown) and other gauges like fuel level gauge, commonly found on larger boats that provide useful functions and information for the rider. Numeral 64 is a vertical axis of rotation of the motorized wakeboard 10 when airborne. As shown in FIG. 2, the stem 14 and the stem 16 define a longitudinal axis 66 which extends through the interior compartment 24. A fuel tank 68, inside the hull 12, communicates with the engine 36, via a fuel line 70. The fuel tank 68 contains fuel for the engine to combust. An exhaust system 72 includes an expansion chamber 74, attached to the engine 36 and an exhaust pipe 76 that connects the expansion chamber 74 with an exterior 80 of the motorized wakeboard 10. The exhaust pipe 76 terminates at an exhaust termination point 78 of the stern 16. In another embodiment (not shown) the exhaust pipe terminates on a side of the motorized wakeboard. Numeral 82 designates the geometrical center of the motorized wakeboard 10. Numeral 84 is a horizontal axis of rotation of the motorized wakeboard 10 when the motorized wakeboard 10 is airborne.

An air inlet 86 allows a fresh air 88 to enter the interior compartment 24 from the exterior 80, so as to provide oxygen for engine to combust. The air 88 enters the air inlet 86 through an air inlet opening 90. The air inlet 86 communicates with a traditional water separator 92, also known as a water trap. The water separator 92 separates the outside water 50 from the fresh air, to prevent the engine and the other components mounted inside the motorized wakeboard from being damaged by the outside water 50 that may enter the air inlet 86. The fresh air 88 exits the water separator 92 through a water separator opening 94. In an alternative embodiment (not shown), the opening 94 is connected with the engine 36 via a conduit (not shown). A drainage conduit 96 removes any water 50 which may enter the water separator 92. One end of the drainage conduit 96 is connected to the water separator 92 and the other end is connected to the water pump 42 at a drainage termination end 98. The pump 42 applies the negative pressure it creates to the drainage conduit 96 such that the drainage conduit removes the water 50 from the water separator 92 through the pump 42.

A fin 100 extends down from the bottom 18 into the water 50. The fin is located in the close proximity to the stern. The fin 100 enhances maneuverability of the motorized wakeboard 10.

When the motorized wakeboard 10 is airborne, the rear portion 20*a* and a water surface 102 define an angle of attack 104 of the motorized wakeboard.

As shown in FIGS. 1–4, the engine 36 is so positioned that when the rider assumes a riding position, the engine center of gravity 44 is coaxial with the center of gravity 34 of the rider 28 so as to minimize the vertical rotational moment of inertia of the motorized wakeboard 10 around the vertical axis 64. This results in the rider 28 having one foot in front of the engine 36, and the other foot behind the engine 36, with rider body directly above the engine 36. The rider position of the rider 28, thus the center of gravity 34 of the rider 28, depends on the length of the motorized wakeboard 10. For a motorized wakeboard of 2.44 to 3.35 m (8 to 11 feet) in length, the center of gravity 34 is approximately 0.54 m (1.77 feet) from the geometrical center 82 of the motorized wakeboard towards the stern. The shorter the waveboard, the closer to the center 82 the rider position is, thus the closer to the center 82 the engine 36 is mounted. For the motorized wakeboard below 1.5 m (5 feet) in length, the riding position, thus the center of gravity 34, is directly above the center 82 of the motorized wakeboard 10. This results in positioning the engine closer to the geometrical center of the motorized wakeboard as the length of the motorized wakeboard decreases, so as to always have the center of gravity of the engine below the center of gravity of rider as rider operates the motorized wakeboard.

The rider 28 mounts the motorized wakeboard 10 from any direction. The rider 28 accelerates the motorized wakeboard by the throttle cable 58 attached to the control device 62 in the handle 60. It must be appreciated that other mechanisms for controlling engine output can be and were used by us in our prototypes. These mechanisms include but are not limited to: remote radio control, infrared light control, and ultrasound remote control. If other mechanisms of controlling engine power are used, the throttle cable 58 and the handle 60 may be eliminated.

During accelerating, the rider 28 assumes the proffered position as shown in FIG. 1. This position is correct for a wakeboard of 8 feet in length as presented in the preferred embodiment. This position offers most control over the wakeboard. It is recommended to assume this position after the motorized wakeboard 10 reaches a speed of about 7 km/hr (5 mph), as it is less stable when motionless. There are many ways to make a turn on the motorized wakeboard, but the two most practiced are described subsequently. To turn in the direction the rider 28 is facing, the rider exerts pressure on the toes of both feet and simultaneously shifts most of his weight over the rear foot. To turn in the opposite direction, the rider 28 exerts pressure on his heels with simultaneous shifting weight over his rear foot. The second way of making a turn, which is more appropriate for a shorter waveboard, about 2.1 m (7 feet) in length, is to exert equal pressure on the toes of both feet to turn the direction a rider is facing or exert equal pressure on the heels to turn the opposite direction, and simultaneously bend both knees, and lean into the direction of the turn. This technique is practiced on wakeboards and snowboards. For very tight turns, rider 28 must also lean very deeply into the turn to counteract centrifugal forces. Both types of turning can be performed with or without the foot straps.

The hull 12 at the engine center of gravity 44 defines a height and a width. The ratio between the height with respect to the width is no greater than 0.60. This facilitates the rider's 28 ability to maneuver the wakeboard 10.

The uniqueness of the present invention is the ability to perform controlled jumps above water surface. To execute a jump of a wakeboard on a flat water, the rider must rock the craft by exerting pressure initially on his front foot, followed by immediate exerting pressure on his rear foot with simultaneous accelerating of the motorized wakeboard. If executed properly, the motorized wakeboard accelerates at the moment when the stem 14 is substantially higher than the stern 16. This causes the thrust direction that coincides with the water stream direction 56 to push the motorized wakeboard 10 into a new trajectory above water surface.

Another way of jumping above water is to use wakes or waves as ramps for jump. If the speed of the motorized wakeboard is height enough, preferable over 32 km per hour (20 miles per hour), rider 28 turns the motorized wakeboard perpendicular to a wave so as the motorized wakeboard 10 no longer rides on a horizontal surface of water but starts climbing up wave at an inclined angle (not shown). This angle of inclination adds a vertical projection to the motorized wakeboard speed. This vertical projection changes into a vertical inertia that lifts the wakeboard above water when the motorized wakeboard reaches the top of the wave. Without the benefits of the present invention, a continuation of this jump would turn into an uncontrolled flight that would most of the time result in a crash landing. Such a crash landing is very dangerous for the rider and for the motorized wakeboard.

When the motorized wakeboard of the present invention becomes airborne, it is possible for the rider 28 to easily change the angle of attack 104 of the motorized wakeboard, by shifting pressure from one foot to the other. The foot straps will substantially improve this maneuver. With both feet in the foot straps, the rider will easily lift front of the motorized wakeboard (the stem) and by lowering his rear foot, will lower the rear of the motorized wakeboard (the stern). The opposite maneuver of decreasing the angle of attack can be performed as easily. The preferred landing technique is to make the motorized wakeboard contact water with its rear (the stern) first, so as to gradually absorb the shock of landing. The motorized wakeboard induces highest landing stress, when the entire bottom surface of the motorized wakeboard comes into contact with water all at the same time. This should be avoided. The opposite to the recommended landing technique, landing the stem first, slows the motorized wakeboard, therefore the inertia of the rider pushes the rider forward and tries to separate the rider from the motorized wakeboard. This landing technique should also be avoided.

The ability to execute proper landing is critical. Low moment of the rotational inertia of the present invention around the horizontal axis 84 that lays below and at the same distance from either of rider foot, makes such maneuvers safe and effortless. More experienced riders will also rotate the motorized wakeboard left and right while airborne. To accomplish this, rider, whose feet are strapped to the deck, will spin the motorized wakeboard around its vertical axis of rotation. Due to the engine position that coincides with the vertical axis 64 that passes through rider center of gravity 34, the low rotational moment of inertia of the motorized wakeboard around the axis 64 enables rider to rotate the craft without excessively rotating himself in the opposite direction. In the prior art the rider would have to rotate over 120 degrees to induce the board rotation of less than 15 degrees. Such degree of rider rotation is not safe and for most people impossible to accomplish.

Accordingly, it can be seen that, according to the invention, we have provided a self propelled board type watercraft that enables a rider to perform jumps above water surface, both on flat water and on waves, similar to those jumps attributed to wakeboarding, sailboarding, and kiteboarding without the need for a towing boat, sail or a kite. The low rotational moment of inertia of the craft enables an average strength person to operate and fully control the craft during jumps above water surface. As stated, the engine is housed below a large flat deck, thereby it does not interfere with the operation of the rider, if the craft should be built of a short length.

Although the description above contains may specificities, these should not be construed as limiting the scope of the invention but as merely providing illustrations of some of the presently preferred embodiments of this invention. Various other embodiments and ramifications are possible within its scope. For example, a different engine controlling device can be used, including a remote radio control, therefore eliminating the throttle cable.

Thus the scope of the invention should be determined by the appended claims and their legal equivalents, rather than by the examples given.

We claim:

1. A wakeboard assembly for transporting a rider, defining a rider center of gravity, across a body of water, said wakeboard assembly comprising:

a hull extending between a stem and a stem and defining a hull center, interior compartment, and a deck for receiving the rider thereon during operation of said wakeboard assembly;

an engine mounted to said hull within said interior compartment, said engine mounted to said hull at a position between said stem and said stem below said deck such that said engine extends through the center of gravity of the rider; and footstraps spaced equidistantly from said engine center to aid the rider in aligning the center of gravity of the rider with said engine center of gravity to maximize the maneuverability of said wake board.

2. A wakeboard assembly as set forth in claim 1 wherein said engine defines an engine center of gravity coaxial with the center of gravity of the rider.

3. A wakeboard assembly as set forth in claim 2 including a water pump extending through a portion of said hull adjacent said stern thereof.

4. A wakeboard assembly as set forth in claim 3 wherein said water pump includes a propeller operatively secured to said engine for moving water through said water pump to propel said wakeboard assembly across the body of water.

* * * * *